US007845392B2

(12) United States Patent
Morita

(10) Patent No.: US 7,845,392 B2
(45) Date of Patent: Dec. 7, 2010

(54) HEAT EXCHANGER ASSEMBLY

(75) Inventor: Michiko Morita, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 1201 days.

(21) Appl. No.: 10/567,783

(22) PCT Filed: Mar. 11, 2005

(86) PCT No.: PCT/GB2005/000950

§ 371 (c)(1),
(2), (4) Date: Feb. 9, 2006

(87) PCT Pub. No.: WO2005/087523

PCT Pub. Date: Sep. 22, 2005

(65) Prior Publication Data

US 2008/0223559 A1 Sep. 18, 2008

(30) Foreign Application Priority Data

Mar. 12, 2004 (JP) ..... 2004-071144

(51) Int. Cl.
*B60H 1/00* (2006.01)

(52) U.S. Cl. ..... 165/43; 165/41; 165/51; 165/140; 180/65.31

(58) Field of Classification Search ..... 165/41, 165/42, 43, 44, 51, 52, 202, 140; 180/65.31
See application file for complete search history.

(56) References Cited

U.S. PATENT DOCUMENTS

| | | | | |
|---|---|---|---|---|
| 4,190,105 | A | 2/1980 | Dankowski | |
| 5,526,873 | A * | 6/1996 | Marsais et al. | 165/51 |
| 6,173,766 | B1 * | 1/2001 | Nakamura et al. | 165/140 |
| 6,189,604 | B1 | 2/2001 | Yamauchi et al. | |
| 6,860,349 | B2 * | 3/2005 | Ogawa et al. | 180/65.31 |
| 7,178,579 | B2 * | 2/2007 | Kolb | 165/41 |
| 7,290,593 | B2 * | 11/2007 | Kolb | 165/41 |
| 7,328,739 | B2 * | 2/2008 | Watanabe et al. | 165/41 |

FOREIGN PATENT DOCUMENTS

| | | | |
|---|---|---|---|
| EP | 0 859 209 | A | 8/1998 |
| JP | H02-90321 | U | 7/1990 |
| JP | 2001-136756 | A | 5/2001 |
| JP | 2002-004860 | A | 1/2002 |
| JP | 2003-118396 | A | 4/2003 |

* cited by examiner

*Primary Examiner*—Ljiljana (Lil) V Ciric
(74) *Attorney, Agent, or Firm*—Global IP Counselors, LLP

(57) ABSTRACT

A heat exchanger assembly has a first heat exchanger with a first heat radiating area receiving a first cooling fluid, a second heat exchanger with a second heat radiating area receiving a second cooling fluid and a third heat radiating area receiving a third cooling fluid. In use, the difference in temperature between the first cooling fluid entering and exiting the first heat radiating area is greater than the difference in temperature between the second cooling fluid entering and exiting the second heat radiating area and greater than the difference in temperature between the third cooling fluid entering and exiting the third heat radiating area. The temperature of the second cooling fluid flowing through the second heat radiating area is higher than the temperature of the third cooling fluid flowing through the third heat radiating area.

22 Claims, 3 Drawing Sheets

HEAT EXCHANGER ASSEMBLY

CROSS-REFERENCE TO RELATED APPLICATIONS

This nonprovisional application claims priority under 35 U.S.C. §119(a) to Japanese Patent Application No. 2004-71144, filed in Japan on Mar. 12, 2004, the entire contents of which are hereby incorporated by reference.

BACKGROUND

1. Field of the Invention

The present invention generally relates to a heat exchanger assembly for radiating heat from three cooling fluids. More specifically, the present invention relates but not exclusively, to a heat exchanger assembly for use in a vehicle.

2. Background Information

A known heat exchanger that radiates heat from multiple cooling fluids is equipped with a pair of tanks comprising multiple tubes and fins between them. Each of the multiple tubes includes a sealed section at its midpoint to divide the passage formed by each of the multiple tubes into first and second passages. Thus the first passages on one side of the heat exchanger are connected to one of the pair of tanks and are formed in a U-shape, and the second passages on the other side of the heat exchanger are connected to the other of the pair of tanks and are also formed in a U-shape. The aforementioned arrangement provides two exchangers in a single heat exchanger body. Such a heat exchanger is described in published Japanese Patent Application No. 10-73388 (Zexel Corp.).

However, regarding the above mentioned known heat exchanger, in cases where three cooling fluids are utilized and the passages of the first and the second heat exchangers are U-shaped, this would result in a third heat exchanger being positioned in front of, or behind, the other heat exchangers. Consequently, the thickness of the heat exchanger body would increase, resulting in an increase in the total size of the heat exchanger.

In addition, if the third heat exchanger were to be mounted to either the right or left hand side of the first and second heat exchangers, the width of the heat exchanger body would increase, resulting in an increase in the total size of the heat exchanger. Furthermore, in cases where a cooling fan is included, there would be variations in the cooling performance of each heat exchanger, leading to a reduction in cooling performance.

Furthermore, known conventional heat exchangers have a very complex flow channel construction for the refrigerant, making them difficult to manufacture.

SUMMARY

An object of the present invention is to provide a heat exchanger assembly that radiates heat from three cooling fluids which can easily be manufactured using existing heat exchangers. Another object of the present invention is to provide a heat exchanger assembly which avoids a drop in cooling performance without increasing the overall size of the heat exchanger assembly.

According to one aspect of the present invention, there is provided a heat exchanger assembly for cooling three cooling fluids, the heat exchanger assembly comprising: a first heat exchanger comprising a first heat radiating area arranged to receive a flow of a first cooling fluid and to radiate heat therefrom; and a second heat exchanger comprising a second heat radiating area arranged to receive a flow of a second cooling fluid and to radiate heat therefrom and a third heat radiating area arranged to receive a flow of a third cooling fluid and to radiate heat therefrom; wherein the second and third cooling fluids are disposed parallel to the respective second and third heat radiating areas, and the second and third heat radiating areas are disposed rearward of the first heat radiating area, and wherein, in use, the difference in temperature between the first cooling fluid entering the first heat radiating area and exiting the first heat radiating area is greater than the difference in temperature between the second cooling fluid entering the second heat radiating area and exiting the second heat radiating area and greater than the difference in temperature between the third cooling fluid entering the third heat radiating area and exiting the third heat radiating area, and the temperature of the second cooling fluid flowing through the second heat radiating area is higher than the temperature of the third cooling fluid flowing through the third heat radiating area, and wherein the second heat radiating area is disposed on the upstream side of the flow direction of the first cooling fluid in the first heat radiating area, and the third heat radiating area is located on the downstream side of the flow direction of the first cooling fluid in the first heat radiating area.

In another aspect of the present invention, there is provided a heat exchanger assembly for cooling three cooling fluids, the heat exchanger assembly comprising: a first heat exchanger comprising a first heat radiating area arranged to receive a flow of a first cooling fluid and to radiate heat therefrom; and a second heat exchanger comprising a second heat radiating area arranged to receive a flow of a second cooling fluid and to radiate heat therefrom and a third heat radiating area arranged to receive a flow of a third cooling fluid and to radiate heat therefrom; wherein the second and third cooling fluids are disposed parallel to the respective second and third heat radiating areas, and the second and third heat radiating areas are disposed rearward of the first heat radiating area, and wherein, in use, the temperature of the first cooling fluid flowing through the first heat radiating area is higher than the temperature of the second cooling fluid flowing through the second heat radiating area, and the temperature of the second cooling fluid flowing through the second heat radiating area is higher than the temperature of the third cooling fluid flowing through the third heat radiating area, and wherein the second heat radiating area is disposed on the upstream side of the flow direction of the first cooling fluid in the first heat radiating area, and the third heat radiating area is located on the downstream side of the flow direction of the first cooling fluid in the first heat radiating area.

Preferably, the area of the first heat radiating area disposed on a first face of the first heat exchanger is substantially the same as the combined areas of the second and third heat radiating areas disposed on a first face of the second heat exchanger, the first faces being arranged to receive an airflow in use.

Preferably, the first heat exchanger is disposed substantially parallel to the second heat exchanger.

The second and third heat radiating areas may be disposed adjacent to one another, and the second heat radiating area may be disposed between a first, third heat radiating area portion and a second, third heat radiating area portion, said third heat radiating portions forming the third heat radiating area.

The heat exchanger assembly of the present invention is particularly suitable for use in a vehicle having an air conditioning unit, a fuel cell and a drive motor, and wherein the first cooling fluid may be arranged to transfer heat from the air conditioning unit to the first heat radiating area, the second cooling means may be arranged to transfer heat from the fuel cell to the second heat radiating area, and the third cooling means may be arranged to transfer heat from the drive motor to the third heat radiating area. Alternatively, however, the heat exchanger assembly may have application in other fields, and its use is not limited to vehicle applications.

Preferably, in use, the first cooling fluid flows from the air conditioning unit to the first heat radiating area via a first cooling fluid inlet passageway, and from the first heat radiating area to the air conditioning unit via a first cooling fluid outlet passageway, and wherein the first heat exchanger further comprises a first cooling fluid inlet for receiving the first cooling fluid from the first cooling fluid inlet passageway, and a first cooling fluid outlet for permitting the flow of the first cooling fluid out of the first heat exchanger and into the first outlet passageway.

Preferably, in use, the second cooling fluid flows from the fuel cell to the second heat radiating area via a second cooling fluid inlet passageway, and from the second heat radiating area to the fuel cell via a second cooling fluid outlet passageway, and wherein the second heat exchanger further comprises a second cooling fluid inlet for receiving the second cooling fluid from the second cooling fluid inlet passageway, and a second outlet for permitting the flow of the second cooling fluid out of the second heat exchanger and into the second cooling fluid outlet passageway.

Preferably, the third cooling fluid is transferred from the drive motor to the third heat radiating area via a third cooling fluid inlet passageway, and from the third heat radiating area to the drive motor via a third cooling fluid outlet passageway, and wherein the second heat exchanger further comprises a third cooling fluid inlet for receiving the third cooling fluid from the third cooling fluid inlet passageway, and a third cooling fluid outlet for permitting the flow of the third cooling fluid out of the second heat exchanger and into the third cooling fluid outlet passageway.

Advantageously, in use, the relative temperatures of the cooling fluids at the first, second and third cooling fluid inlets are given by the relationship: $\text{Temperature}_{first\ cooling\ fluid\ inlet} > \text{Temperature}_{second\ cooling\ fluid\ inlet} > \text{Temperature}_{third\ cooling\ fluid\ inlet}$, and wherein the relative temperatures of the cooling fluids at the first, second and third cooling fluid outlets are given by the relationship: $\text{Temperature}_{second\ cooling\ fluid\ outlet} > \text{Temperature}_{third\ cooling\ fluid\ outlet} > \text{Temperature}_{first\ cooling\ fluid\ outlet}$.

Preferably, the second cooling fluid in the second heat radiating area flows in a straight line from an upper area of the vehicle to a lower area of the vehicle, and the third cooling fluid in the third heat radiating area flows in a straight line from an upper area of the vehicle to a lower area of the vehicle.

As stated above, the present invention concerns heat exchanger assembly equipped with independent heat radiating areas that radiate heat from three cooling fluids. The second and third fluids are arranged so that they are parallel to the second and third heat radiating areas, where they each flow at the rear face of the first cooling fluid where the first heat radiating area flows. Among these three heat radiating areas, the difference in the temperature of the cooling fluid of the mutual port opening of the first cooling fluid is the greatest. The second cooling fluid where the temperature of the second heat radiating area flows is relatively higher than the third cooling fluid where the third heat radiating area flows. The second heat radiating area is located at the rear face on the upstream side of the first cooling fluid flow for the first heat radiating area, while on the other hand, the third heat radiating area is located at the rear surface on the downstream side of the first cooling fluid flow for the first heat radiating area.

In one embodiment of the present invention, the second heat radiating area (whose cooling fluid temperature is lower than the third heat radiating area) is located on the upstream side of the cooling fluid of the first heat radiating area. As a result, the second heat radiating area whose cooling fluid temperature is high, and even if the required cooling fluid temperature is low, the difference in vapor temperature is maintained, leading to an increase in heat exchange efficiency. On the other hand, the third heat radiating area (whose cooling fluid temperature is lower than the second heat radiating area) may be located on the downstream side of the cooling fluid of the first heat radiating area. As a result, even if the required cooling fluid temperature of the third heat radiating area is low, the difference in vapor temperature is maintained, leading to an increase in heat exchange efficiency.

The second and third cooling fluids are arranged so that they are parallel to the second and third heat radiating fluids where they each flow at the rear surface of the first cooling fluid where the first heat radiating area flows. Among these three heat radiating areas, the cooling fluid temperature of the first cooling fluid is the greatest (i.e. relatively higher than the others). The second cooling fluid where the temperature of the second heat radiating area flows is relatively higher than the third cooling fluid where the third heat radiating area flows. The second heat radiating area is located at the rear surface on the upstream side of the first cooling fluid flow for the first heat radiating area, while on the other hand, the third heat radiating area is located at the rear surface on the downstream side of the first cooling fluid flow for the first heat radiating area.

Furthermore, the second and third heat radiating areas are located at the rear surface of the first heat radiating area. For the first heat radiating area, the cooling fluid mutual port opening flows at a greater cooling medium as compared to the difference in the cooling fluid mutual port opening of the second and third heat radiating areas. As a result, a cooling wind, or cooling airflow, contacts the entire front surface of the first heat radiating area, improving the heat transfer efficiency of the first heat radiating area. In addition, for the second and third heat radiating areas located behind the rear surface of the first heat radiating area, the efficiency of heat radiation is sufficiently maintained by allowing a cooling fluid of a smaller amount than the first cooling fluid to heat radiation.

As a result, even if a cooling fan is mounted at the rear surface of the heat exchanger assembly, the desired cooling performance of each heat radiating area can be maintained, which prevents any reduction in cooling performance.

In addition, compared to other prior cases where three cooling fluids are flowed in a heat exchanger assembly that used a U-shape for the cooling fluid passage, this heat exchanger assembly can be made thinner and can be made more compact.

Furthermore, as the cooling fluid flow direction of the cooling fluid for the heat radiating area can be a straight line, it can be manufactured from existing heat exchangers, improving the ease of production.

According to this invention, therefore, the second and third heat radiating areas are located at the back of the first heat radiating area. The cooling fluid that has the highest relative temperature flows through the first heat radiating area. As a result, the cooling airflow contacts the entire area of the first heat radiating area, and the heat radiating efficiency of the first heat radiating area can be increased. In addition, the amount of heat radiation of the cooling fluids of the second and third heat radiating areas located at the back of the first heat radiating area are not as great as that of the first heat radiating area. Therefore, sufficient heat radiation efficiency can be maintained.

Furthermore, the surface area of the face that opposes the cooling airflow of the first heat radiating area and the combined surface area of the faces that oppose the airflow of the second and third heat radiating area is nearly the same as previously mentioned, and the first, second and third heat radiating areas are in the same position by the airflow direction. Consequently, it is ensured that there will be a sufficient amount of cooling airflow to the third heat radiating area that is behind the cooling fluid outlet of the first heat radiating area, which in turn assures sufficient cooling performance.

In addition, the vehicle may be equipped with an air conditioner and a fuel cell, as well as a high voltage device that receives electrical power from the fuel cell. The first cooling fluid or medium that flows through the first heat radiating area flows to the air conditioner, the second cooling fluid that flows through the second heat radiating area flows to the fuel cell, while the third cooling fluid that flows through the third heat radiating area flows to the high voltage device. Consequently, the previously described benefits can be realized for fuel cell vehicles as well.

BRIEF DESCRIPTION OF THE DRAWINGS

Preferred embodiments of the present invention will be described, by way of example only, with reference to the accompanying drawings, in which.

DETAILED DESCRIPTION OF THE PREFERRED EMBODIMENTS

Figure 1:
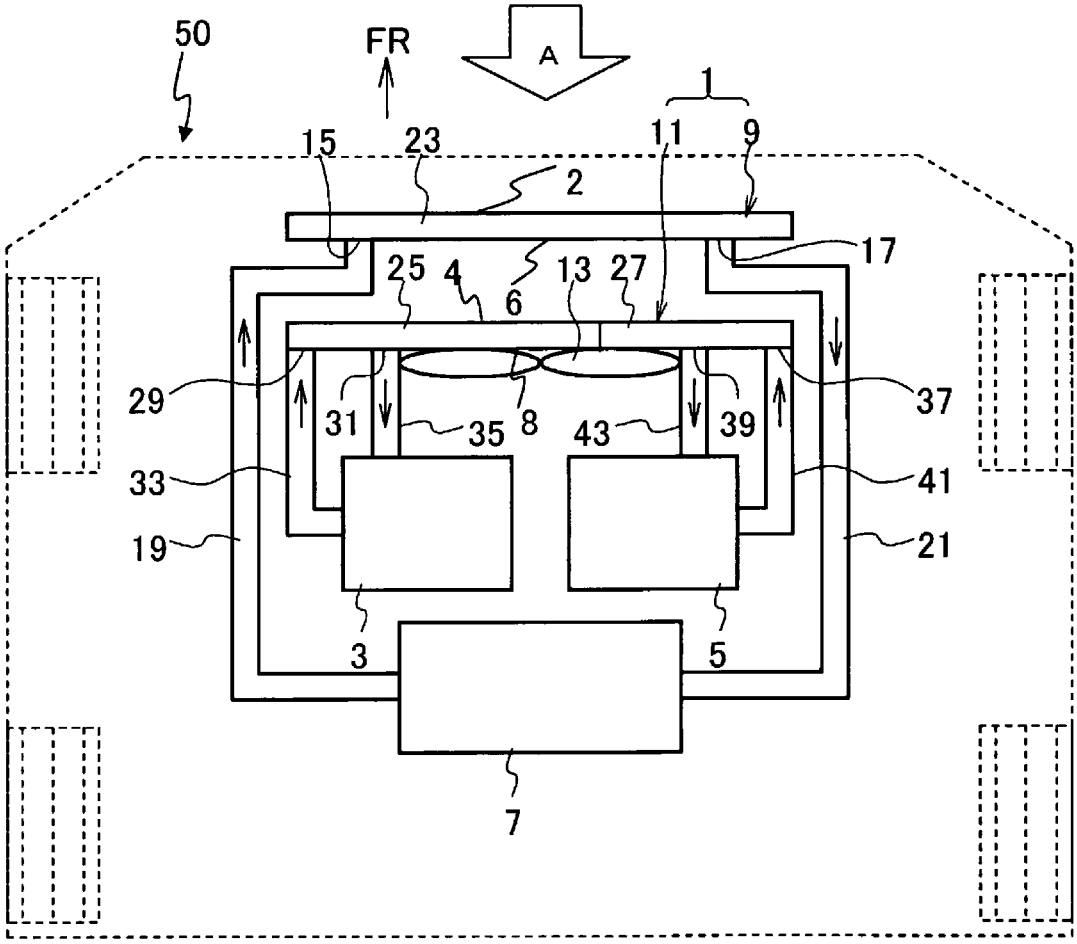
FIG. 1 is a plan view of a schematic representation of a heat exchanger assembly comprising first and second heat exchangers, according to presently preferred embodiments.

Referring to FIG. 1, there is shown a plan view of a heat exchanger assembly 1 which is suitable for implementing all the presently preferred embodiments. The heat exchanger assembly 1 may be used to remove heat from a fuel cell 3, a drive motor 5 and an air conditioning unit 7 provided in a fuel cell vehicle (50). The drive motor 5 comprises part of a high voltage device that powers the vehicle and which receives electrical power from the fuel cell 3. The arrow FR shown in FIG. 1 indicates the front of the vehicle. When the vehicle is moving forwards, a cooling airflow A travels from the front to the rear of the vehicle in a direction indicated by the solid arrow in FIG. 1.

The heat exchanger assembly 1 illustrated in FIG. 1 comprises a first heat exchanger 9 located towards the front of the vehicle, and a second heat exchanger 11 located behind the first exchanger 9, towards the rear of the vehicle. The first heat exchanger 9 comprises a first face 2 which faces the front of the vehicle and is arranged to receive the airflow A, and a second face 6 which faces the rear of the vehicle. The second heat exchanger 11 also comprises a first face 4 which faces the front of the vehicle and is also arranged to receive the airflow A, and a second face 8 which faces the rear of the vehicle. A cooling fan 13 is mounted on the second face 8 of the second heat exchanger 11.

The rear face 6 of the first heat exchanger 9 is provided with a first heat radiating area 23 which radiates heat to cool a first cooling fluid, also referred to as a first cooling medium.

The second heat exchanger 11 is provided with second and third heat radiating areas 25 and 27 which each radiate heat to cool respective second and third cooling fluids, which may also be referred to as second and third cooling mediums. The construction of the heat exchanger assembly 1 will now be explained in more detail.

On the left side of the cross direction of the vehicle (the lateral direction in FIG. 1), the first heat exchanger 9 is provided with a first cooling fluid inlet 15 that is the inlet for the first cooling fluid, while on the right side, the first heat exchanger 9 is provided with a first cooling fluid outlet 17 that is the outlet for the first cooling fluid. The air conditioning unit 7 is connected to the first cooling fluid inlet 15 via a first cooling fluid inlet passageway 19, and to the first cooling fluid outlet 17 via a first cooling fluid outlet passageway 21. In use, the first cooling fluid flows through the first heat exchanger 9, exits the first heat exchanger 9 via the first cooling fluid outlet 17, and flows along the first cooling fluid outlet passageway 21 to the air conditioning unit 7. The first cooling fluid then flows from the air conditioning unit 7 along the first cooling fluid inlet passageway 19, and back into the first heat exchanger 9 via the first cooling fluid inlet 17.

The second heat exchanger 11 is provided with a second cooling fluid inlet 29 for receiving the second cooling fluid for cooling the second heat radiating area 25, and a second cooling fluid outlet 31 through which the second cooling fluid exits. The fuel cell 3 is connected to the second cooling fluid inlet 29 via a second cooling fluid inlet passageway 33, and to the second cooling fluid outlet 31 via a second cooling fluid outlet passageway 35. In use, the second cooling fluid flows through a portion of the second heat exchanger 11 that is associated with the second heat radiating area 25, exits the second heat exchanger 11 via the second cooling fluid outlet 31, and flows along the second cooling fluid outlet passageway 35 to the fuel cell 3. The second cooling fluid then flows from the fuel cell 3 along the second cooling fluid inlet passageway 33, and back into the second heat exchanger 11 via the second cooling fluid inlet 29.

The second heat exchanger 11 additionally comprises a third cooling fluid inlet 37 for receiving the third cooling fluid for cooling the third heat radiating area 27, and a third cooling fluid outlet 37 through which the third cooling fluid exits. The drive motor 5 is connected to the third cooling fluid inlet 39 via a third cooling fluid inlet passageway 41, and to the third cooling fluid outlet 39 by a third cooling fluid outlet passageway 43. In use, the third cooling fluid flows through a portion of the second heat exchanger 11 that is associated with the third heat radiating area 27, exits the second heat exchanger 11 via the third cooling fluid outlet 39, and flows along the third cooling fluid outlet passageway 43 to the drive motor 5. The third cooling fluid then flows from the drive motor 5 along the third cooling fluid inlet passageway 41, and back into the second heat exchanger 11 via the third cooling fluid inlet 37.

The second heat radiating area 25 is provided at the rear surface of, or behind, the first heat exchanger 9, and is positioned on the upstream side of the flow of the first cooling fluid provided to the first cooling fluid inlet 15 of the first heat exchanger 9. The third heat radiating area 27 is provided at the rear surface of, or behind, the first heat exchanger 9, and is positioned on the downstream side of the flow of the first cooling fluid provided from the first cooling fluid outlet 17 of the first heat exchanger 9. In other words, "upstream" is intended to mean the cooling fluid inlet side (15) of the first heat radiating area (23) and "downstream" is intended to mean the cooling fluid outlet side (17) of the first heat radiating area (23). The terms "upstream" and "downstream" are used in a similar context for the inlet and outlet sides of the second and third heat radiating areas.

Referring now to FIG. 2*a*, the arrows indicate the flow direction of the first cooling fluid in the first heat radiating area 23 of the first heat exchanger 9. That is, the first cooling fluid flows in a straight line from the left hand side to the right hand side of the vehicle.

Referring to FIG. 2*b*, the flow direction of the second cooling fluid in the second heat radiating area 25 is indicated by the broken line arrow. That is, the second cooling fluid flows in a straight line from the upper area of the vehicle to the lower area of the vehicle. In addition, the third cooling fluid in the third heat radiating area 27 flows in a straight line from the upper area of the vehicle to the lower area of the vehicle, as shown by the dot-dash line arrow.

The surface area of the face 2 that opposes the airflow A of the first heat radiating area 23 and the combined surface area of the faces 4 that oppose the airflow of the second heat radiating area 25 and the third heat radiating area 27 are nearly the same.

Next, the cooling function of the heat exchanger assembly 1 will be explained. In use, the air conditioning unit 7 produces heat which is transferred to the first cooling fluid. The heated first cooling fluid flows along the first cooling fluid inlet passageway 19 and into the first heat exchanger 9 via the first cooling fluid inlet 15. The heated first cooling fluid flows through the first heat exchanger 9 in the direction indicated by the arrows shown in FIG. 2*a*. Here, the first cooling fluid is cooled by exchanging heat with the first heat radiating area 23, and heat loss from the first heat radiating area 23 is aided by the cooling airflow A (by way of heat radiation). The temperature of the first cooling fluid exiting the first heat exchanger 9 via the first cooling fluid outlet 17 is therefore lower than the temperature of the first cooling fluid entering the first heat exchanger via the first cooling fluid inlet 15. The cooled first cooling fluid then exits the first heat exchanger 9 via the first cooling fluid outlet 17, and flows to the air conditioning unit 7 via the first cooling fluid outlet passageway 21. The first cooling fluid is then used by the air conditioning unit to produce cool air for the vehicle.

The fuel cell 3 also produces heat in use. In the same manner as described above, this heat is transferred to the second cooling fluid. More specifically, the heated second cooling fluid flows along the second cooling fluid inlet passageway 33 and into the second heat exchanger 11 via the second cooling fluid inlet 29. The heated second cooling fluid flows through the second heat exchanger 11 in the direction indicated by the dashed arrow shown in FIG. 2*b*. Here, the second cooling fluid is cooled by exchanging heat with the second heat radiating area 25, and heat loss from the second radiating area 25 is aided by the cooling airflow A (by way of heat radiation). The temperature of the second cooling fluid exiting the second heat exchanger 11 via the second cooling fluid outlet 31 is therefore lower than the temperature of the second cooling fluid entering the second heat exchanger 11 via the second cooling fluid inlet 29. The cooled second cooling fluid then exits the second heat exchanger 11 via the second cooling fluid outlet 31, and flows to the fuel cell 3 via the second cooling fluid outlet passageway 35. The cool second cooling fluid is then used to cool the fuel cell 3.

The drive motor 5 also produces heat in use. In the same manner as described above, this heat is transferred to the third cooling fluid. More specifically, the heated third cooling fluid flows along the third cooling fluid inlet passageway 41 and into the second heat exchanger 11 via the third cooling fluid inlet 37. The heated third cooling fluid flows through the second heat exchanger 11 in the direction indicated by the dot-dash arrow shown in FIG. 2*b*. Here, the third cooling fluid is cooled by exchanging heat with the third heat radiating area 27, and heat loss from the third heat radiating area 27 is aided by the cooling airflow A (by way of heat radiation). The temperature of the third cooling fluid exiting the second heat exchanger 11 via the third cooling fluid outlet 39 is therefore lower than the temperature of the third cooling fluid entering the second heat exchanger 11 via the third cooling fluid inlet 37. The cooled third cooling fluid then exits the second heat exchanger 11 via the third cooling fluid outlet 39, and flows to the drive motor 5 via the third cooling fluid outlet passageway 43. The cooled third cooling fluid is then used to cool the drive motor 5.

For the heat exchanger assembly 1, if the temperatures of the cooling fluids at the inlets (IN) 15, 29 and 37 of each of the first, second, and third heat radiating areas 23, 25 and 27 are compared to the temperatures of the cooling fluids at the outlets (OUT) 17, 31 and 39 of each of the first, second, and third heat radiating areas 23, 25 and 27, the following relationship is observed:

Temperature (first heat radiating area IN)>Temperature (second heat radiating area IN)>Temperature (third heat radiating area IN), and Temperature (second heat radiating area OUT)>Temperature (third heat radiating area OUT)>Temperature (first heat radiating area OUT).

Furthermore, with regard to the amount of radiating heat (i.e. the difference in temperature between the cooling fluid inlet 15, 29 and 37 and the corresponding outlet 17, 31 and 39 required by the first, second, and third heat radiating areas 23, 25, and 27), the first heat radiating area 23 is the greatest.

In a heat exchange process such as the one mentioned above, the second heat radiating area 25 (which has a higher temperature cooling fluid than the third heat radiating area 27) is located at the back of the first heat radiating area 23, on the near side of the first cooling fluid inlet 15 of the first heat exchanger 9. As a result, the second heat radiating area 25 can maintain the difference in vapor temperature even with a significant rise in vapor temperature due to the high temperature of the cooling fluid. Therefore, a high heat exchange efficiency can be achieved.

On the other hand, the third heat radiating area 27 (which has a lower temperature cooling fluid than the second heat radiating area 25) is located at the back of the first heat radiating area 23 on the near side of the first cooling fluid outlet 17 of the first heat exchanger 9. As a result, the third heat radiating area 27 can maintain the difference in vapor temperature even if the required temperature for the cooling fluid is low. Therefore, high heat exchange efficiencies can be achieved.

The above information shows how the heat exchanger assembly 1 carries out heat radiation from three cooling fluids and can prevent reductions in cooling performance. At the same time, compared to known prior art heat exchangers with U-shaped cooling passages that perform heat radiation with three cooling fluids, the body of the heat exchanger assembly is thinner and more compact. In addition, the cooling fluid flow direction in the first, second, and third heat radiating areas 23, 25, and 27 can be made in a straight-line shape. As a result, the heat exchanger assembly 1 can be manufactured from existing heat exchangers, resulting in improved ease of production.

Furthermore, the second heat exchanger 11 is located at the rear of first heat exchanger 9. As a result, even when the flow direction of the cooling fluids of the first and second heat exchangers 9 and 11 cross each other, the second and third heat radiating areas 25 and 27 are arranged to be parallel to each other along the flow of the first cooling fluid at the rear, as shown in FIGS. 2*a* and 2*b*. The length along the direction of flow of the cooling fluids of the second and third heat radiating areas 25 and 27 are therefore shortened. As a result, the outlet temperature of the cooling fluids of second and third heat radiating areas 25 and 27 can be kept uniform along the flow of the first cooling fluid.

In addition, the first heat exchanger 9 with the greatest amount of flowing radiating heat (via the first heat radiating area 23) is located at the front of the vehicle. As a result, the airflow A contacts the entire front face 2 of the first heat exchanger 9, improving the heat radiating efficiency of the first heat exchanger 9. In addition, the amount of heat radiation of the second heat exchanger 11 located behind the first heat exchanger 9 is not as great as that of the first heat exchanger 9. As a result, the heat radiating benefit of the heat exchanger assembly 1 can be maintained.

In cases where the first heat exchanger 9 is extremely large (or the second heat exchanger 11 is extremely small), there is a case in which the first cooling fluid flowing through the first heat radiating area 23 cannot perform sufficient cooling (for example, near the first cooling fluid inlet 15).

However, the surface area of the face 2 that opposes the airflow A of the first heat radiating area 23 and the combined surface area of the faces 4 that oppose the airflow of the second heat radiating area 25 and the third heat radiating area 27 are nearly the same. As a result, the first heat exchanger 9 and the second heat exchanger 11 are in the same position in terms of airflow A direction. This ensures that the third heat radiating area 27 is behind the first cooling fluid outlet 17 of the first heat exchanger 9 and receives the cooling airflow A, thus ensuring the cooling performance. In this case, the cooling airflow A will be distributed to the third heat radiating area 27.

FIGS. 3*a* and 3*b* illustrate the flow paths of the cooling fluids in the first and second heat exchangers 9 and 11 respectively, according to a second embodiment.

Referring to FIG. 3*a*, in this embodiment the first cooling fluid flows in a so-called serpentine shape, or snake-like fashion, winding its way from the first cooling fluid inlet 15 provided on the upper left hand side of the first heat exchanger 9 to the first cooling fluid outlet 17 provided on the upper right hand side of the first heat exchanger 9, as illustrated by the solid arrows.

The broken line arrow of FIG. 3*b* illustrates the flow path of the second cooling fluid in the second heat radiating area 23: the second cooling fluid flows in a straight line from the upper area to the lower area of the vehicle, as in the first embodiment. The dot-dash line arrow of FIG. 3*b* illustrates the flow path of the third cooling fluid in the third heat radiating area 25: the third cooling fluid flows in a straight line from the upper area to the lower area of the vehicle, again as in the first embodiment.

FIGS. 4*a* and 4*b* illustrate the flow paths of the cooling fluids in the first and second heat exchangers 9 and 11 respectively, according to a third embodiment.

In this embodiment, the first cooling fluid inlet 15 of the first heat exchanger 9 is mounted in the middle of the upper area of the vehicle (i.e. in the middle of the upper portion of the first heat exchanger 9). Additionally, two cooling fluid outlets 17*a* and 17*b* are provided on the upper left and upper right hand sides of the vehicle (i.e. one outlet 17*a* on the upper left hand side of the first heat exchanger 9 and the other outlet 17*b* on the upper right hand side of the first heat exchanger 9).

As FIG. 4*a* shows, the first cooling fluid of the first heat radiating area 23 flows from the first cooling fluid inlet 15 in the upper middle area of the vehicle over to the cooling fluid outlets 17*a* and 17*b* in the upper left and upper right hand sides, respectively, of the vehicle. There are therefore two flow paths for the first cooling fluid in the first heat exchanger 9 in this embodiment: a first U-shaped flow path X from the first cooling fluid inlet 15 to one 17*a* of the first cooling fluid outlets; and a second U-shaped flow path Y from the first cooling fluid inlet 15 to the other 17*b* of the first cooling fluid outlets.

Referring now to FIG. 4*b*, the second heat radiating area 25 is provided in a central portion of the second heat exchanger 11, while the third heat radiating area comprises two portions 27*a* and 27*b*, one portion positioned on either side of the central second heat radiating area 25. The flow paths of the respective second and third cooling fluids in the second and third heat radiating areas 25 and 27 are similar to those shown in FIG. 2*a*, that is, they flow from the upper area to the lower area of the vehicle (i.e. from the upper area of the second heat exchanger 11 to the lower area thereof).

As for the first embodiment, in the second and third embodiments the second heat radiating area 25 is located at the rear of the first cooling fluid inlet 15 of first heat radiating area 23 (i.e. towards the rear of the vehicle), while the third heat radiating area 27 is located at the rear of the first cooling fluid outlet 17 of first heat radiating area 23 (i.e. towards the rear of the vehicle).

In summary, the heat exchanger assembly 1 comprises three cooling fluids that radiate heat, while preventing an increase in the size of the overall heat exchanger, as well as preventing a drop in performance. In addition, the heat exchanger assembly 1 is easy to produce from existing heat exchangers. The first heat exchanger 9 that uses the air conditioning unit 7 is placed at the front of the vehicle, after which the second heat exchanger 11 that uses the fuel cell 3 and the drive motor 5 is positioned. The first heat exchanger 9 is equipped with the first heat radiating area 23 where the first cooling fluid flows. The second heat exchanger 11 is aligned in parallel with the second heat radiating area 25 where the first cooling fluid of the fuel cell 3 flows, and with the third heat radiating area 27 where the third cooling fluid of the drive motor 5 flows. The second heat radiating area 25 is connected to the fuel cell 3 in which the temperature of the cooling fluid is higher than that of the drive motor 5, and is located behind the cooling fluid inlet 15 of the first heat exchanger 9. In addition, the third heat radiating area 27 connected to the drive motor 5 in which the temperature of the third cooling fluid is higher than the fuel cell 3 is located behind the cooling fluid outlet 17 of the first heat exchanger 9.

Having described particular preferred embodiments of the present invention, it is to be appreciated that the embodiments in question are exemplary only and that variations and modifications such as will occur to those possessed of the appropriate knowledge and skills may be made without departure from the scope of the invention as set forth in the appended claims.

Figure 2:
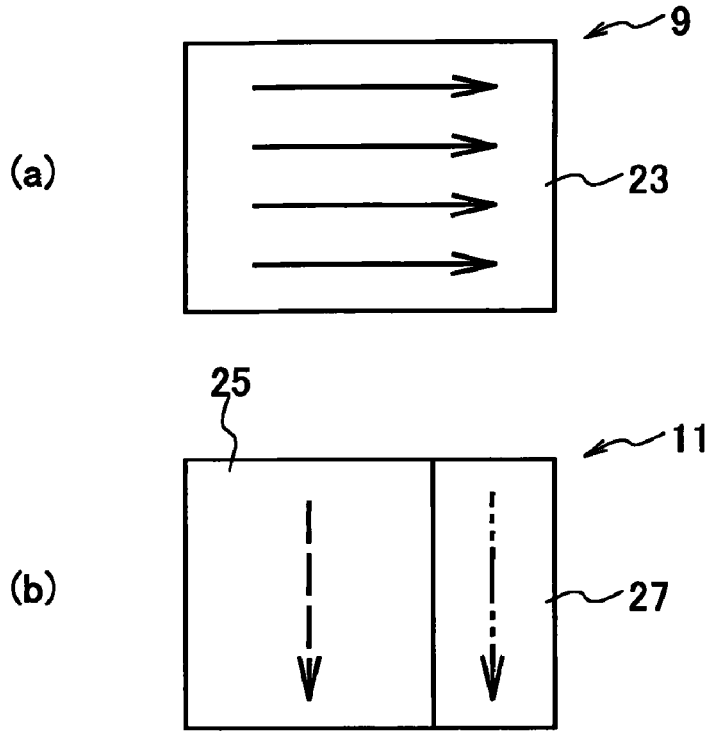
FIG. 2*a* is a rear view of the first heat exchanger of FIG. 1 which illustrates the flow path of a first cooling fluid in a first heat radiating area, according to a first embodiment.
FIG. 2*b* is a rear view of the second heat exchanger of FIG. 1 which illustrates the flow paths of a second cooling fluid in a second heat radiating area and a third cooling fluid in a third heat radiating area, according to the first embodiment.
Figure 3:
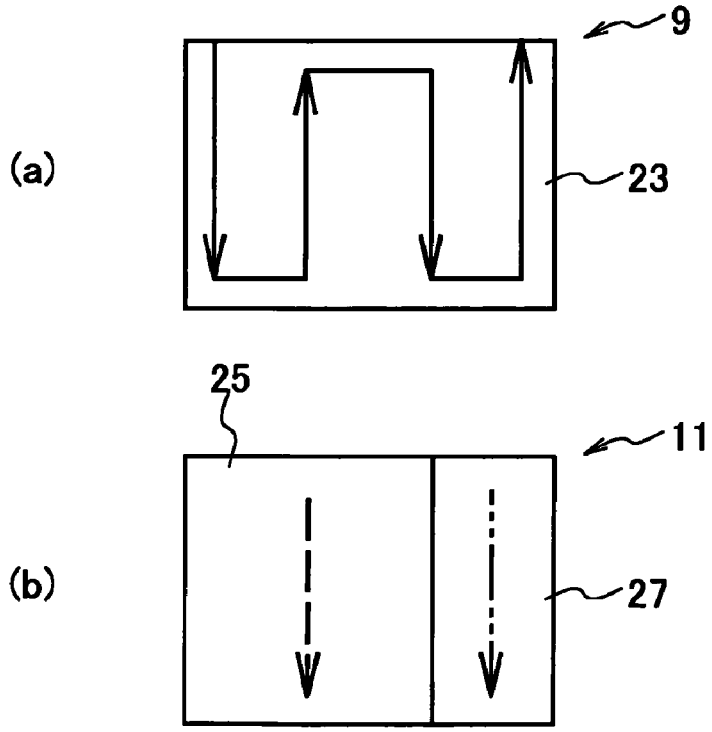
FIG. 3*a* is a rear view of the first heat exchanger of FIG. 1 which illustrates the flow path of a first cooling fluid in a first heat radiating area, according to a second embodiment.
FIG. 3*b* is a rear view of the second heat exchanger of FIG. 1 which illustrates the flow paths of a second cooling fluid in a second heat radiating area and a third cooling fluid in a third heat radiating area, according to the second embodiment.
Figure 4:
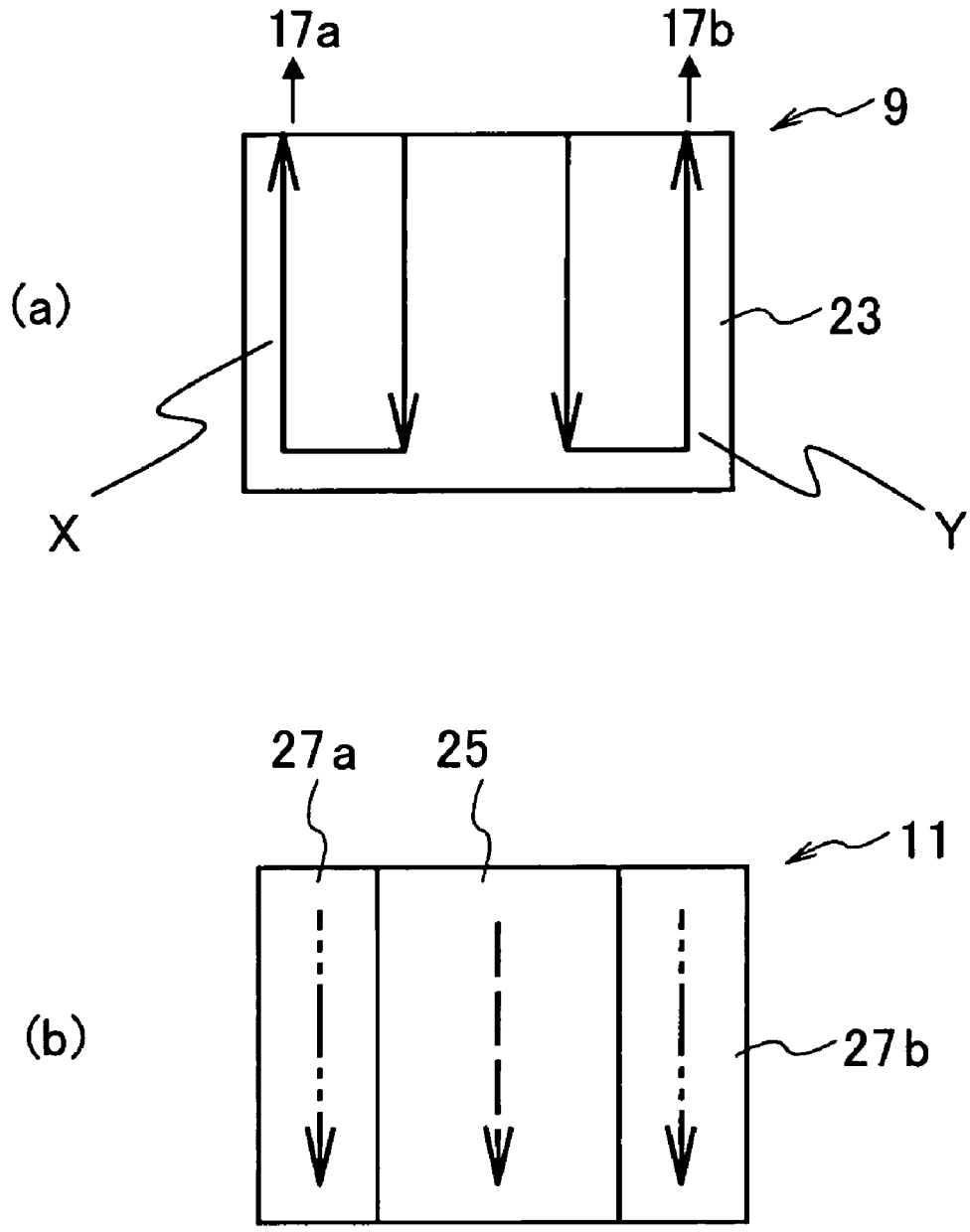
FIG. 4*a* is a rear view of the first heat exchanger of FIG. 1 which illustrates the flow path of a first cooling fluid in a first heat radiating area, according to a third embodiment.
FIG. 4*b* is a rear view of the second heat exchanger of FIG. 1 which illustrates the flow paths of a second cooling fluid in a second heat radiating area and a third cooling fluid in a third heat radiating area, according to the third embodiment.

For example, it will be appreciated that although the flow paths of the cooling fluids have been specified in relation to FIGS. 2, 3 and 4, the directions of these flow paths may be rotated by 90, 180 or 270 degrees, provided there is sufficient space. Additionally, although the first cooling fluid inlet passageway 19 has been described as being on the left hand side of the vehicle, and the first cooling fluid outlet passageway 21 on the right hand side of the vehicle, it will be appreciated that these positions may be reversed, as long as the other inlet and outlet cooling fluid passageways are appropriately positioned such that the temperature relationships between the cooling fluids at the cooling fluid inlets 15, 29 and 37 and cooling fluid outlets 17, 31 and 39 of the heat exchangers 9 and 11 are observed.

The invention claimed is:

1. A heat exchanger assembly for cooling three cooling fluids, the heat exchanger comprising:

a vehicle air conditioning unit;

a vehicle fuel cell;

a vehicle drive motor;

a first heat exchanger comprising a first heat radiating area arranged to receive a flow of a first cooling fluid flowing through the vehicle air conditioning unit and to radiate heat therefrom; and a second heat exchanger comprising a second heat radiating area arranged to receive a flow of a second cooling fluid flowing through the vehicle fuel cell and to radiate heat therefrom, and a third heat radiating area arranged to receive a flow of a third cooling fluid flowing through the vehicle drive motor and to radiate heat therefrom, the second and third cooling fluids being disposed parallel to the respective second and third heat radiating areas, and the second and third heat radiating areas being disposed rearward of the first heat radiating area, a difference in temperature between the first cooling fluid entering the first heat radiating area and exiting the first heat radiating area is greater than a difference in temperature between the second cooling fluid entering the second heat radiating area and exiting the second heat radiating area and greater than a difference in temperature between the third cooling fluid entering the third heat radiating area and exiting the third heat radiating area, and a temperature of the second cooling fluid flowing through the second heat radiating area is higher than a temperature of the third cooling fluid flowing through the third heat radiating area, and the second heat radiating area being disposed on an upstream side of a flow direction of the first cooling fluid in the first heat radiating area, and the third heat radiating area being located on a downstream side of the flow direction of the first cooling fluid in the first heat radiating area.

2. The heat exchanger assembly according to claim 1, wherein an area of the first heat radiating area disposed on a first face of the first heat exchanger is substantially the same as combined areas of the second and third heat radiating areas disposed on a first face of the second heat exchanger, the first faces being arranged to receive an airflow.

3. The heat exchanger assembly according to claim 1, wherein the first heat exchanger is disposed substantially parallel to the second heat exchanger.

4. The heat exchanger assembly according to claim 1, wherein the second and third heat radiating areas are disposed adjacent one another.

5. The heat exchanger assembly according to claim 1, wherein the second heat radiating area is disposed between a first third heat radiating area portion and a second third heat radiating area portion.

6. The heat exchanger assembly according to claim 1, wherein the first cooling fluid flows from the air conditioning unit to the first heat radiating area via a first cooling fluid inlet passageway, and from the first heat radiating area to the air conditioning unit via a first cooling fluid outlet passageway, and the first heat exchanger further comprises a first cooling fluid inlet for receiving the first cooling fluid from the first cooling fluid inlet passageway, and a first cooling fluid outlet for permitting a flow of the first cooling fluid out of the first heat exchanger and into the first cooling fluid outlet passageway.

7. The heat exchanger assembly according to claim 6, wherein the second cooling fluid flows from the fuel cell to the second heat radiating area via a second cooling fluid inlet passageway, and from the second heat radiating area to the fuel cell via a second cooling fluid outlet passageway, and the second heat exchanger further comprises a second cooling fluid inlet for receiving the second cooling fluid from the second cooling fluid inlet passageway, and a second cooling fluid outlet for permitting the flow of the second cooling fluid out of the second heat exchanger and into the second cooling fluid outlet passageway.

8. The heat exchanger assembly according to claim 7, wherein the third cooling fluid is transferred from the drive motor to the third heat radiating area via a third cooling fluid inlet passageway, and from the third heat radiating area to the drive motor via a third cooling fluid outlet passageway, and the second heat exchanger further comprises a third cooling fluid inlet for receiving the third cooling fluid from the third cooling fluid inlet passageway, and a third cooling fluid outlet for permitting the flow of the third cooling fluid out of the second heat exchanger and into the third cooling fluid outlet passageway.

9. The heat exchanger assembly according to claim 8, wherein relative temperatures of the cooling fluids at the first, second and third cooling fluid inlets are given by the relationship:

$\text{Temperature}_{first\ cooling\ fluid\ inlet} >$
$\text{Temperature}_{second\ cooling\ fluid\ inlet} >$
$\text{Temperature}_{third\ cooling\ fluid\ inlet}$, and relative temperatures of the cooling fluids at the first, second and third cooling fluid outlets are given by the relationship:

$$\text{Temperature}_{second\ cooling\ fluid\ outlet} > \text{Temperature}_{third\ cooling\ fluid\ outlet} > \text{Temperature}_{first\ cooling\ fluid\ outlet}.$$

10. The heat exchanger assembly according to claim 1, wherein the second cooling fluid in the second heat radiating area flows in a straight line from an upper area of the vehicle to a lower area of the vehicle.

11. The heat exchanger assembly according to claim 1, wherein the third cooling fluid in the third heat radiating area flows in a straight line from an upper area of the vehicle to a lower area of the vehicle.

12. A heat exchanger assembly for cooling three cooling fluids, the heat exchanger comprising:

a vehicle air conditioning unit;

a vehicle fuel cell;

a vehicle drive motor;

a first heat exchanger comprising a first heat radiating area arranged to receive a flow of a first cooling fluid flowing through the vehicle air conditioning unit and to radiate heat therefrom; and a second heat exchanger comprising a second heat radiating area arranged to receive a flow of a second cooling fluid flowing through the vehicle fuel cell and to radiate heat therefrom, and a third heat radiating area arranged to receive a flow of a third cooling fluid flowing through the vehicle drive motor and to radiate heat therefrom, the second and third cooling fluids being disposed parallel to the respective second and third heat radiating areas, and the second and third heat radiating areas being disposed rearward of the first heat radiating area, a temperature of the first cooling fluid flowing through the first heat radiating area being higher than a temperature of the second cooling fluid flowing through the second heat radiating area, and the temperature of the second cooling fluid flowing through the second heat radiating area being higher than a temperature of the third cooling fluid flowing through the third heat radiating area, and the second heat radiating area being disposed on a upstream side of a flow direction of the first cooling fluid in the first heat radiating area, and the third heat radiating area being located on a downstream side of the flow direction of the first cooling fluid in the first heat radiating area.

13. The heat exchanger assembly according to claim 12, wherein an area of the first heat radiating area disposed on a first face of the first heat exchanger is substantially the same as combined areas of the second and third heat radiating areas disposed on a first face of the second heat exchanger, the first faces being arranged to receive an airflow, in use.

14. The heat exchanger assembly according to claim 12, wherein the first heat exchanger is disposed substantially parallel to the second heat exchanger.

15. The heat exchanger assembly according to claim 12, wherein the second and third heat radiating areas are disposed adjacent one another.

16. The heat exchanger assembly according to claim 12, wherein the second heat radiating area is disposed between a first third heat radiating area portion and a second third heat radiating area portion.

17. The heat exchanger assembly according to claim 12, wherein the first cooling fluid flows from the air conditioning unit to the first heat radiating area via a first cooling fluid inlet passageway, and from the first heat radiating area to the air conditioning unit via a first cooling fluid outlet passageway, and the first heat exchanger further comprises a first cooling fluid inlet for receiving the first cooling fluid from the first cooling fluid inlet passageway, and a first cooling fluid outlet for permitting the flow of the first cooling fluid out of the first heat exchanger and into the first cooling fluid outlet passageway.

18. The heat exchanger assembly according to claim 17, wherein the second cooling fluid flows from the fuel cell to the second heat radiating area via a second cooling fluid inlet passageway, and from the second heat radiating area to the fuel cell via a second cooling fluid outlet passageway, and the second heat exchanger further comprises a second cooling fluid inlet for receiving the second cooling fluid from the second cooling fluid inlet passageway, and a second cooling fluid outlet for permitting the flow of the second cooling fluid out of the second heat exchanger and into the second cooling fluid outlet passageway.

19. The heat exchanger assembly according to claim 18, wherein the third cooling fluid is transferred from the drive motor to the third heat radiating area via a third cooling fluid inlet passageway, and from the third heat radiating area to the drive motor via a third cooling fluid outlet passageway, and the second heat exchanger further comprises a third cooling fluid inlet for receiving the third cooling fluid from the third cooling fluid inlet passageway, and a third cooling fluid outlet for permitting the flow of the third cooling fluid out of the second heat exchanger and into the third cooling fluid outlet passageway.

20. The heat exchanger assembly according to claim 19, wherein relative temperatures of the cooling fluids at the first, second and third cooling fluid inlets are given by the relationship:

$$\text{Temperature}_{first\ cooling\ fluid\ inlet} > \text{Temperature}_{second\ cooling\ fluid\ inlet} > \text{Temperature}_{third\ cooling\ fluid\ inlet}, \text{ and}$$

relative temperatures of the cooling fluids at the first, second and third cooling fluid outlets are given by the relationship:

$$\text{Temperature}_{second\ cooling\ fluid\ outlet} > \text{Temperature}_{third\ cooling\ fluid\ outlet} > \text{Temperature}_{first\ cooling\ fluid\ outlet}.$$

21. The heat exchanger assembly according to claim 12, wherein the second cooling fluid in the second heat radiating area flows in a straight line from an upper area of the vehicle to a lower area of the vehicle.

22. The heat exchanger assembly according to claim 12, wherein the third cooling fluid in the third heat radiating area flows in a straight line from an upper area of the vehicle to a lower area of the vehicle.

* * * * *